US007690310B2

(12) United States Patent
Engel et al.

(10) Patent No.: US 7,690,310 B2
(45) **Date of Patent: *Apr. 6, 2010**

(54) HIGH-PRESSURE FIXED MUNITION FOR LOW-PRESSURE LAUNCHING SYSTEM

(75) Inventors: John Whitworth Engel, 544A Alum Creek Rd., Smithville, TX (US) 78957; Kevin Dexter Dockery, Ray, MI (US); Christopher Luchini, Santa Fe, NM (US)

(73) Assignee: John Whitworth Engel, Smithville, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/316,188

(22) Filed: Dec. 10, 2008

(65) Prior Publication Data

US 2009/0095187 A1 Apr. 16, 2009

Related U.S. Application Data

(63) Continuation of application No. 11/015,014, filed on Dec. 20, 2004, now Pat. No. 7,481,167.

(60) Provisional application No. 60/541,935, filed on Feb. 6, 2004.

(51) Int. Cl.
*F42B 5/36* (2006.01)
*F42B 5/03* (2006.01)

(52) U.S. Cl. ..... 102/452; 42/105

(58) Field of Classification Search ..... 102/451, 102/452, 454; 42/105
See application file for complete search history.

(56) References Cited

U.S. PATENT DOCUMENTS

| | | | | | |
|---|---|---|---|---|---|
| 2,466,714 | A * | 4/1949 | Kroeger et al. | 89/1.703 |
| 3,422,761 | A * | 1/1969 | Whitmore | 102/453 |
| 3,618,250 | A * | 11/1971 | Grandy | 42/77 |
| 3,724,378 | A * | 4/1973 | Knight et al. | 102/456 |
| 3,991,682 | A * | 11/1976 | Peak | 102/438 |
| 4,762,068 | A * | 8/1988 | Lubbers | 102/439 |
| 5,033,386 | A * | 7/1991 | Vatsvog | 102/467 |
| 5,085,147 | A * | 2/1992 | Gold et al. | 102/486 |
| 5,363,769 | A * | 11/1994 | Bellak et al. | 102/446 |
| 5,644,100 | A * | 7/1997 | Puckett et al. | 102/457 |
| 6,041,712 | A * | 3/2000 | Lyon | 102/439 |
| 6,311,623 | B1 * | 11/2001 | Zaruba | 102/371 |
| 7,481,167 | B2 * | 1/2009 | Engel et al. | 102/451 |

* cited by examiner

*Primary Examiner*—Stephen M Johnson
(74) *Attorney, Agent, or Firm*—David O. Simmons

(57) ABSTRACT

A high-pressure fixed munition for a low-pressure launching system having a cylindrical body with a centrally located bore is provided. The bore of the munition has a reduced diameter on the charge end in which a primer charge is positioned. The bore is filled above the primer charge with a propellant and above the propellant with a payload. The payload may include multiple buckshot pellets, frangible buckshot pellets, tear gas, multiple slugs, frangible slugs, paint balls, rubber pellets, bean bags, or the like. The munition may also include a pressure disk between the propellant and the payload, and tactile ridges or on the outside surface of the munition body or be of a specific color for purposes of identification of the payload.

18 Claims, 6 Drawing Sheets

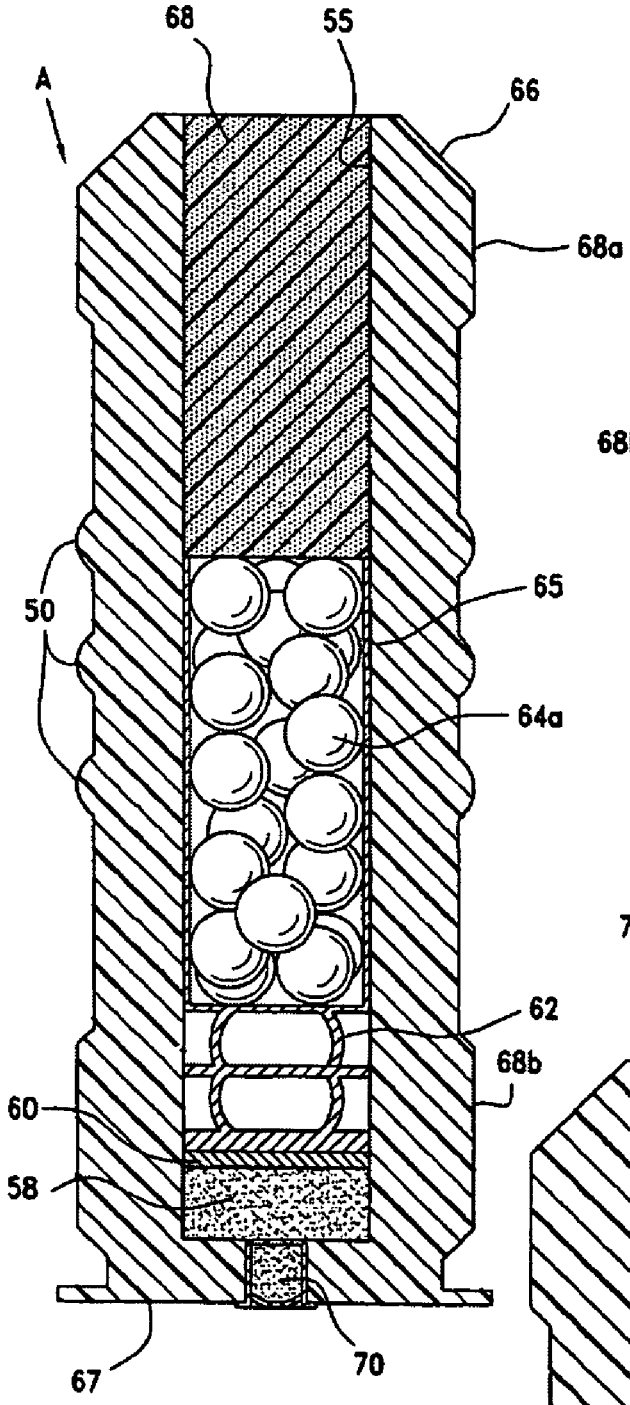
FIG. 8
FIG. 9
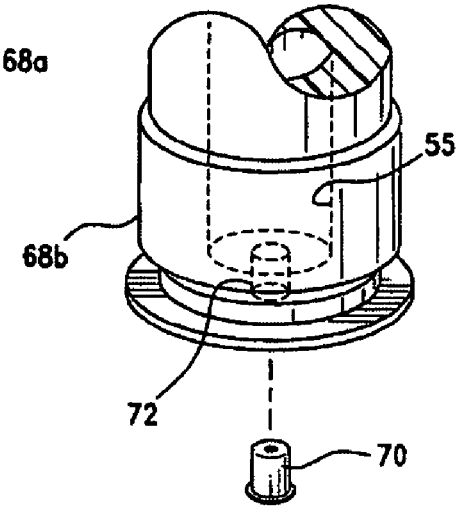
FIG. 10
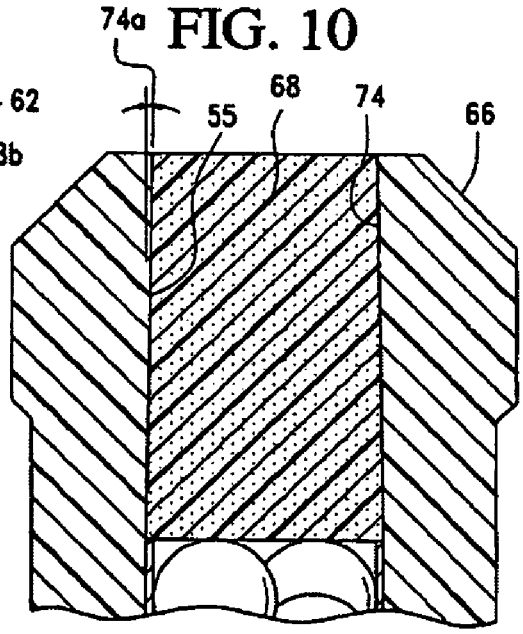

HIGH-PRESSURE FIXED MUNITION FOR LOW-PRESSURE LAUNCHING SYSTEM

CROSS REFERENCE TO RELATED APPLICATIONS

This patent application claims priority from U.S. Non-Provisional Patent Application having Ser. No. 11/015,014, filed on Dec. 20, 2004, now U.S. Pat. No. 7,481,167, entitled "High-Pressure Fixed Munition For Low-Pressure Launching System", having a common applicant herewith and being incorporated herein in its entirety by reference, which claims priority from U.S. Provisional Patent Application having Ser. No. 60/541,935, filed on Feb. 6, 2004, having a common applicant herewith and being incorporated herein in its entirety by reference.

FIELD OF THE DISCLOSURE

The disclosures made herein relate generally to munitions and, more specifically, to munitions designed for low-pressure weapon systems.

BACKGROUND

Beginning in the 1950s, a family of 40 mm grenade launchers was developed to assist soldiers to cover the area between the longest range of the hand grenade (30-40 yards) and the middle range of the 60 mm mortar (300-400 yards). The family of 40 mm grenade launchers includes: the M79, the M203 and the M203a. Each of the 40 mm grenade launchers fires various types of 40 mm cartridges including: high explosive ("HE") rounds, projectile practice rounds, chemical rounds, buckshot rounds and pyrotechnic signal and spotting rounds.

The 40 mm M79 grenade launcher resembles a large bore, single aluminum barrel, sawn off shotgun. The M79 grenade launcher was developed in the 1950s and was first delivered to the US Army in 1961.

The 40 mm M203 grenade launcher was developed to attach to an existing M-16 rifle and M-4 carbine. It consists of a 10-inch long aluminum barrel and a receiver clamped underneath an M-16 barrel. A variation of the M203 is the M203a, which consists of an 8-inch long aluminum barrel and a receiver clamped underneath a M-4 carbine. The working pressure of each of the M79/M203/M203a is 3000 psi.

Because the HE rounds require an arming delay of an internal fuze device, and because of the blast radius associated with the high explosive, the HE round is not effective at close ranges.

To provide close range potential for an M79, M203 or M203a grenade launcher, a shotgun shell type round was developed, known as an XM576. The XM576 includes 20 No. 4 buckshot pellets (each 0.24-inch in diameter) that leave the M79/M203/M203a muzzle at only 885 feet per second. Unfortunately, the XM576 has not performed as hoped either by the military or by law enforcement.

In another effort to improve the close range effectiveness of the M79/M203/M203a family of grenade launchers, a 12-gauge sub-caliber device was developed and was issued to service personnel in Vietnam on an experimental basis. The sub-caliber device consisted of a steel rim and liner with a spring-loaded extractor inside a 40 mm plastic bushing. The device was about 9-inches long and would accept any commercial 12-gauge buckshot load. Other such devices have been constructed in lengths of 5-inches overall. Unfortunately, neither the XM576 nor the sub-caliber devices can provide satisfactory shot patterns or velocity at ranges beyond approximately 10 yards.

What is needed is a device that can be used in existing M79/M203/M203a grenade launchers, or other sizes of low pressure launching systems, to provide a close quarter battle load and at the same time, overcome the problems that exist with the XM576 round and sub-caliber adapters.

SUMMARY OF THE DISCLOSURE

A high-pressure fixed munition for a low-pressure launching system having a cylindrical body with a centrally located bore is provided. The bore of the munition has a reduced diameter on the charge end in which a primer charge is positioned. The bore is filled above the primer charge with a propellant and above the propellant with a payload. The payload may include multiple buckshot pellets, frangible buckshot pellets, tear gas, multiple slugs, frangible slugs, paint balls, rubber pellets, bean bags, or the like. The munition may also include a pressure disk between the propellant and the payload, and tactile ridges or on the outside surface of the munition body or be of a specific color for purposes of identification of the payload.

Closed cell foam can be inserted in the top of the high-pressure fixed munition to seal off the contents from mud, sand, water or other debris.

The resulting inventive high-pressure fixed munition provides an improved muzzle velocity, range and shot pattern in comparison to conventional munitions used with low pressure launching systems.

BRIEF DESCRIPTION OF THE DRAWINGS

FIG. 8 is a sectional view of the inventive high-pressure fixed munition with a shotgun shell primer.

FIG. 9 is a detail assembly view of the primer and base of the inventive high-pressure fixed munition of FIG. 8.

FIG. 10 is a detail partial sectional view of the inventive high-pressure fixed munition shown in FIG. 8 showing the choke feature.

DETAILED DESCRIPTION

The following table, viewed together with the enclosed figures and detailed description, is provided to understand clearly a preferred embodiment of the invention:

| Number: | Description: |
|---|---|
| P1 | XM576 Multiple Projectile Round |
| 12 | Primer |
| 14 | Propellant |
| 14a | Brass Powder Charge Cup |
| 15 | Vent Holes |
| 18 | Low Pressure Chamber |
| 19 | Sabot |
| 22 | Pellets |
| P2 | Sub-Caliber Adapter |
| 32 | Primer |
| 34 | Propellant |
| 35 | 12-Gauge Shotgun Shell |
| 36 | Wad |
| 37 | Shot Cup |
| 39 | Base Surface |
| 42 | Pellets #4 Buckshot |
| 43 | Bore |
| B | M16 Carbine |
| B1 | M203 Grenade Launcher |
| B1A | M203 Grenade Launcher Barrel |
| C | M79 Grenade Launcher |
| C1 | M79 Grenade Launcher Barrel |
| 46 | Breach Face A High Pressure Fixed Munition |
| 50 | Raised Ridges |
| 52 | Body of High-Pressure Fixed Munition |
| 54 | Primer 55 Bore |
| 56 | Shell Casing |
| 57 | Small Bore for Shell Casing |
| 58 | Propellant |
| 58a | Propellant in shell casing |
| 59 | Lower Flat of Large Bore |
| 60 | Burst Disk |
| 62 | Wad |
| 64 | Pellets "00" Frangible Buckshot |
| 64a | Pellets "00" Buckshot |
| 64b | Frangible Slugs |
| 65 | Shot cup |
| 66 | Leading Taper |
| 67 | Base Surface of High-Pressure Fixed Munition |
| 68 | Foam |
| 68a | Upper Large Diameter |
| 68b | Lower Large Diameter |
| 69 | Shotgun Shell Primer |
| 72 | Shotgun Shell Primer Bore |
| 74 | Choked Taper |
| 74a | Choked Taper Angle |

Figure 1:
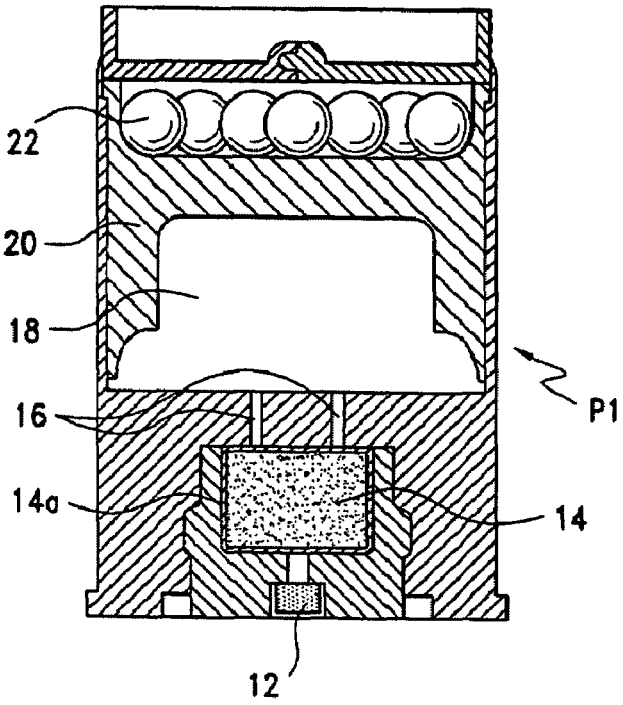
FIG. 1 (PRIOR ART)
FIG. 1 is a cross section view of a 40 mm XM576 multiple projectile round.

Referring now to FIG. 1, an existing prior art XM576 round, designated generally as P1, is shown. The XM576 includes a primer 12 that ignites the propellant 14, which is enclosed within a brass powder charge cup 14*a*. The ignited propellant 14 develops a pressure of 35,000 psi that ruptures the brass charge cup 14*a* at the vent holes 16. The gases that enter the low-pressure chamber 18 from the vent holes 16 are at a pressure of approximately 3000 psi, which propel the pellets 22 toward the intended target.

Figure 2:
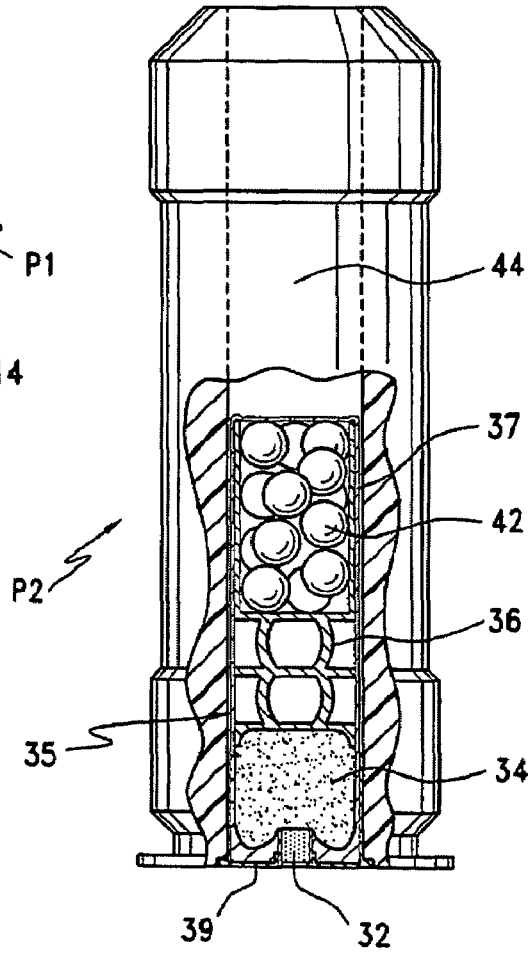
FIG. 2 (PRIOR ART)
FIG. 2 is an outside view of a 40 mm sub-caliber adapter including a cross section view of a conventional 12-gauge shotgun shell.

In FIG. 2, a prior art sub-caliber adapter, generally designated as P2, is shown. The sub-caliber adapter is slightly less than 40 mm on the outside diameter so that it can be used in existing M79/M203/M203a grenade launchers, which have a 40 mm diameter barrel (See FIGS. 3, 3A and 4). It includes a straight through bore 44 that is sized to accommodate a conventional 12-gauge shotgun shell 35. The shotgun shell 35 includes a primer 32 that ignites propellant 34, which expands to launch the pellets 42. The pellets 42 are held together during launching with the wad 36 and wad cup 37.

Figure 3:
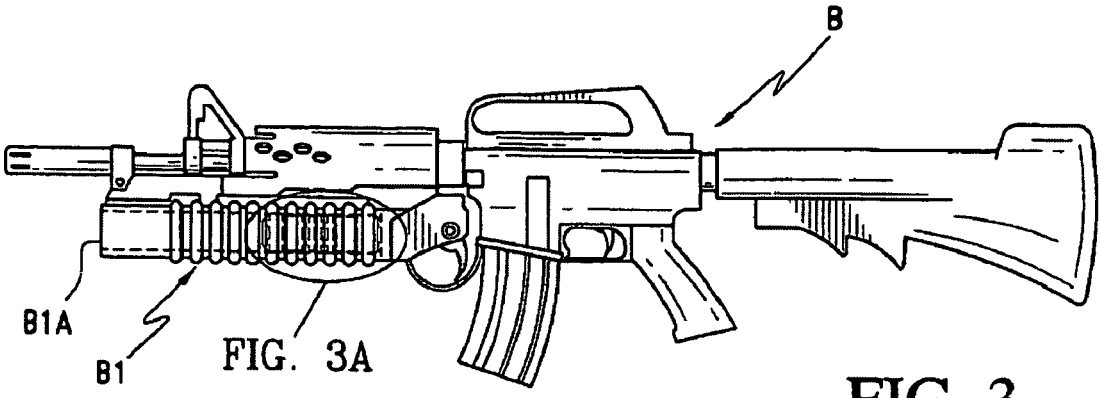
FIG. 3 shows an M203 grenade launcher attached to an M-16 Rifle.
Figure 4:
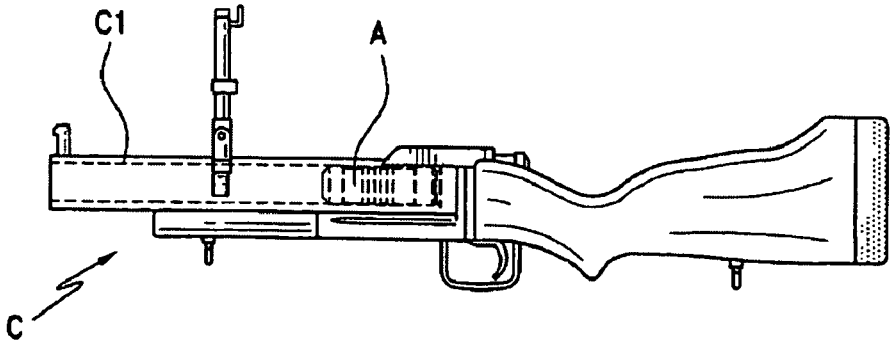
FIG. 4 is an outside view of an M79 grenade launcher.

Both the XM576 (P1) and the sub-caliber adapter (P2) are designed to be fired from an M79 grenade launcher, designated as C in FIG. 4, or from an M203 grenade launcher, designated as B1 in FIG. 3. The M203 grenade launcher B1 is shown mounted to an M-16 carbine B in FIG. 3. Both the XM576 and the sub-caliber adapter may also be fired from an M203a grenade launcher, which is a shorter version of the M203 grenade launcher (B1), which is mounted onto an M-4 (not shown).

Figure 5:
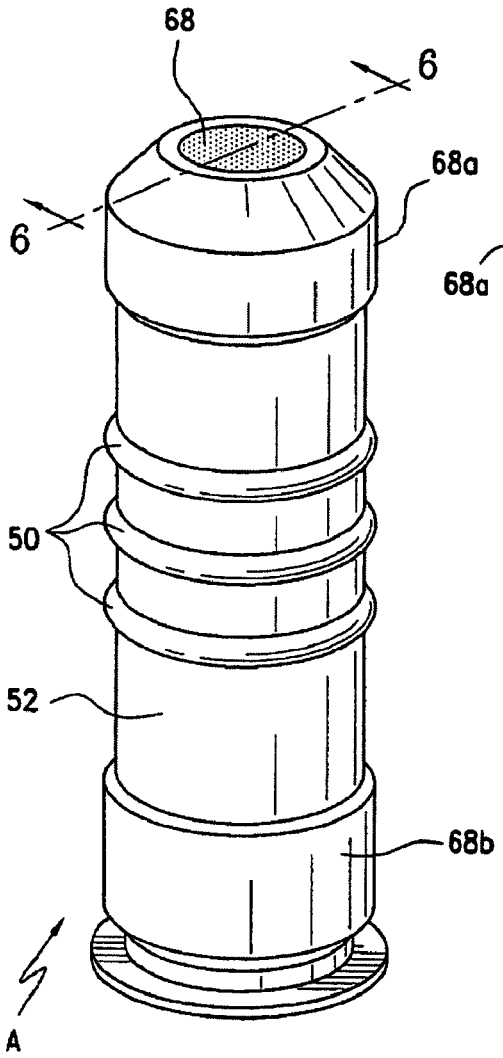
FIG. 5 is an outside view of the inventive high-pressure fixed munition.

The inventive high-pressure fixed munition is designated in FIG. 5 generally as A. The high-pressure fixed munition A is 40 mm on the largest outside diameter and may be fired from the M79 grenade launcher (C) shown in FIG. 4, from the M203 grenade launcher (B1) shown in FIG. 3, or from an M203a grenade launcher (not shown). All of the grenade launchers M79/M203/M203 have a receiving chamber and barrel diameter of 40 mm, which is just slightly greater than the 1.605 inch outside diameter of the high-pressure fixed munition A. The base surface 67 of the high-pressure munition A allows a high internal operating pressure to be spread across the entire base surface 67 to minimize stress on the breach face 46 (shown in FIG. 3A). The base surface 39 of the sub-caliber adapter P2 is limited in surface area and an increase in pressure could damage the breach face 46 of the M79/M203/M203a grenade launcher or the aluminum barrel.

Figure 3A:
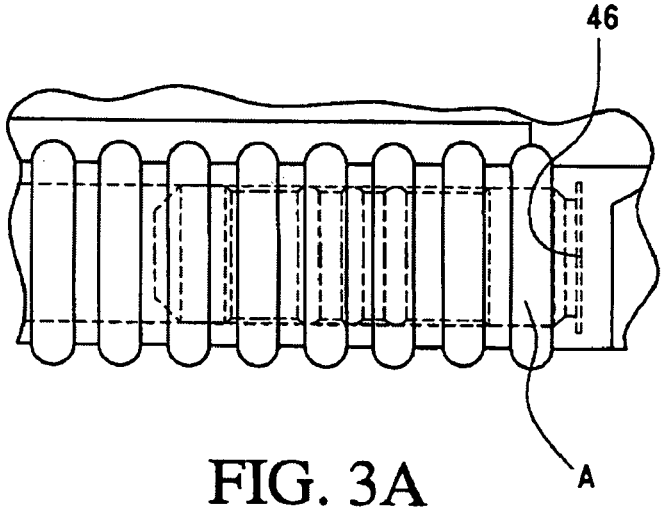
FIG. 3A shows the inventive high-pressure fixed munition inside of the M203 of FIG. 3.

The upper large diameter 68*a* and the lower large diameter 68*b* center the high-pressure munition A within the chamber of the barrel B1*a* and C1 (FIGS. 3, 3A and 4). As shown in FIGS. 5, 6, 6A and 6B, the upper large diameter 68*a* and the lower large diameter 68*b* have respective larger diameters than a reduced diameter portion of the body 52 that extends between the upper large diameter 68*a* and the lower large diameter 68*b*. As such, the upper large diameter 68*a* defines a discharge end step portion and the lower large diameter 68*b* defines a charge end step portion.

Figure 6:
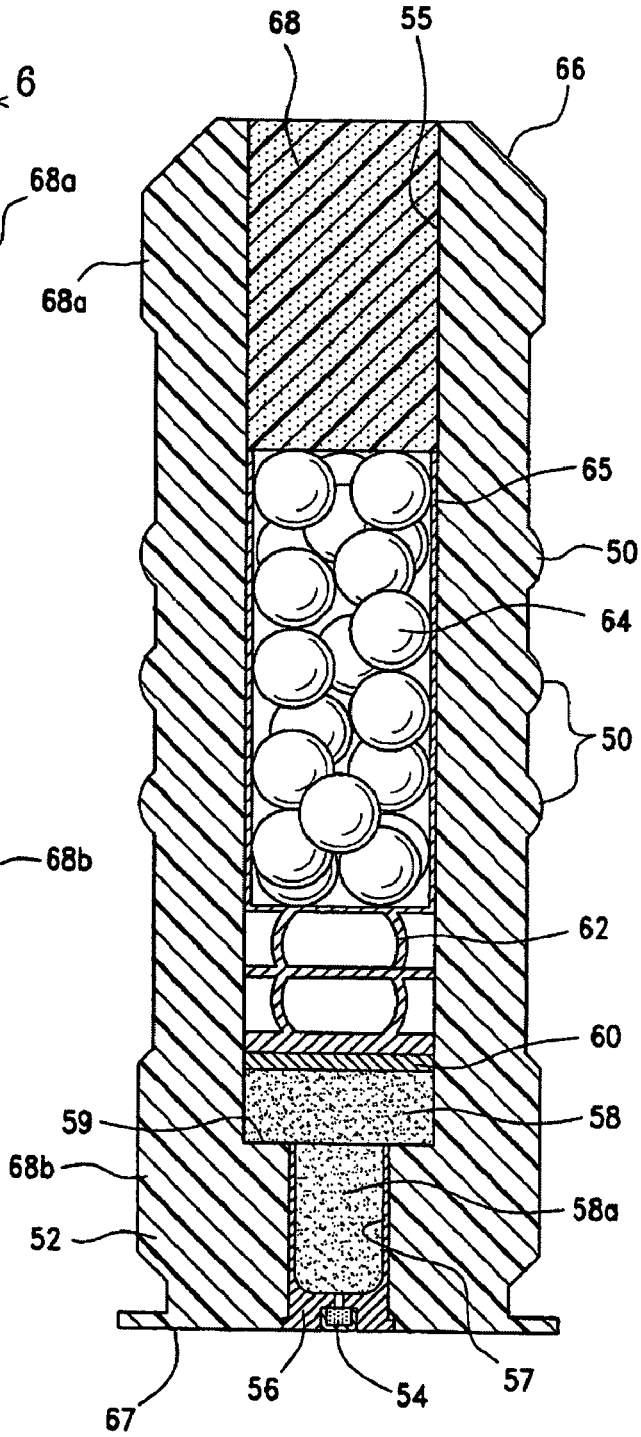
FIG. 6 is a section view of the inventive high-pressure fixed munition shown in FIG. 5 including twenty-five frangible "00" buckshot pellets.
Figure 6A:
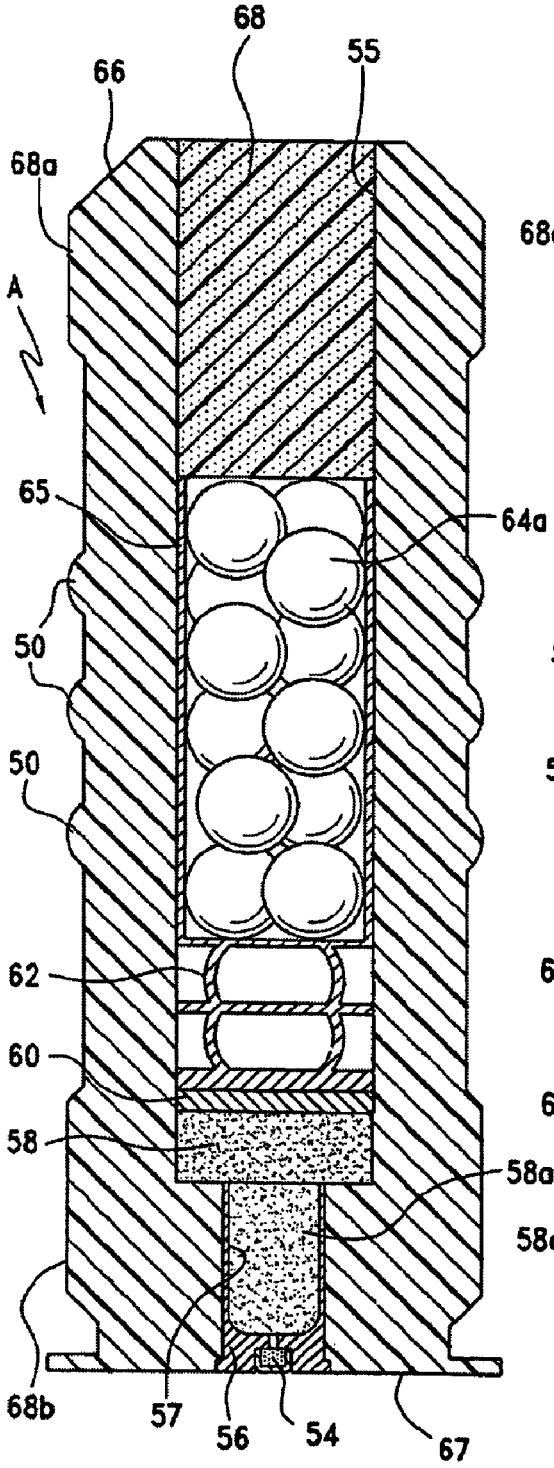
FIG. 6A is a section view of the inventive high-pressure fixed munition shown in FIG. 5 including twenty "00" buckshot pellets.
Figure 6B:
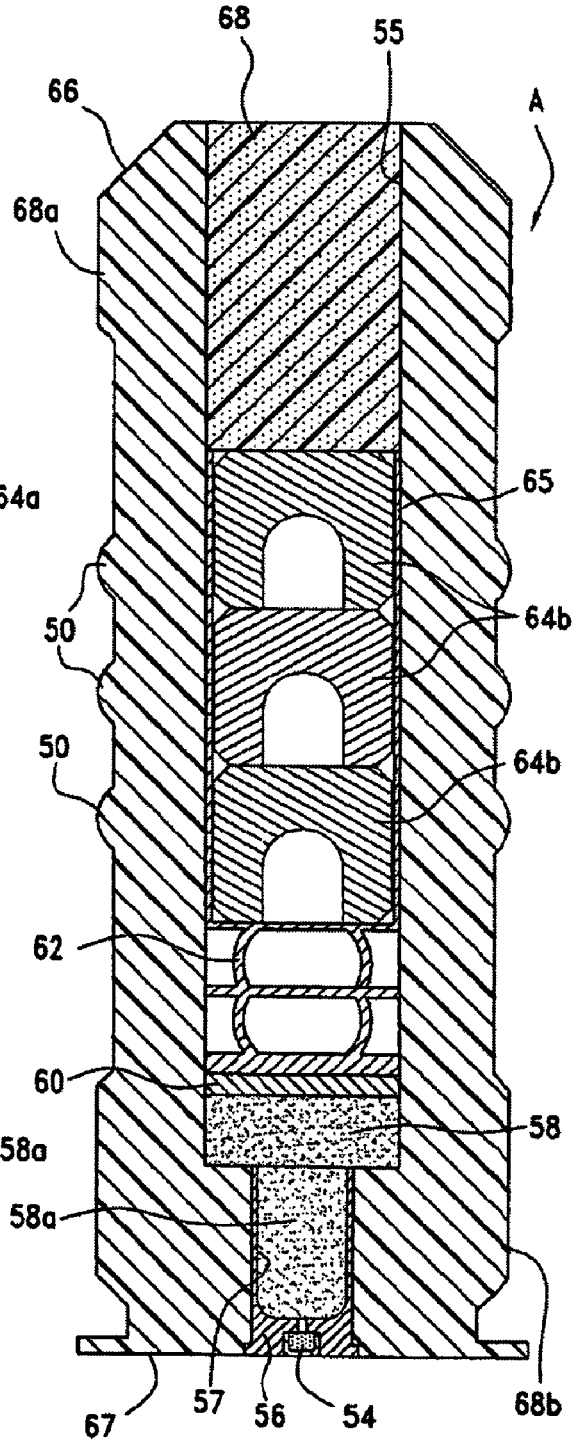
FIG. 6B is a section view of the inventive high-pressure fixed munition shown in FIG. 5 including three frangible slugs.
Figure 7:
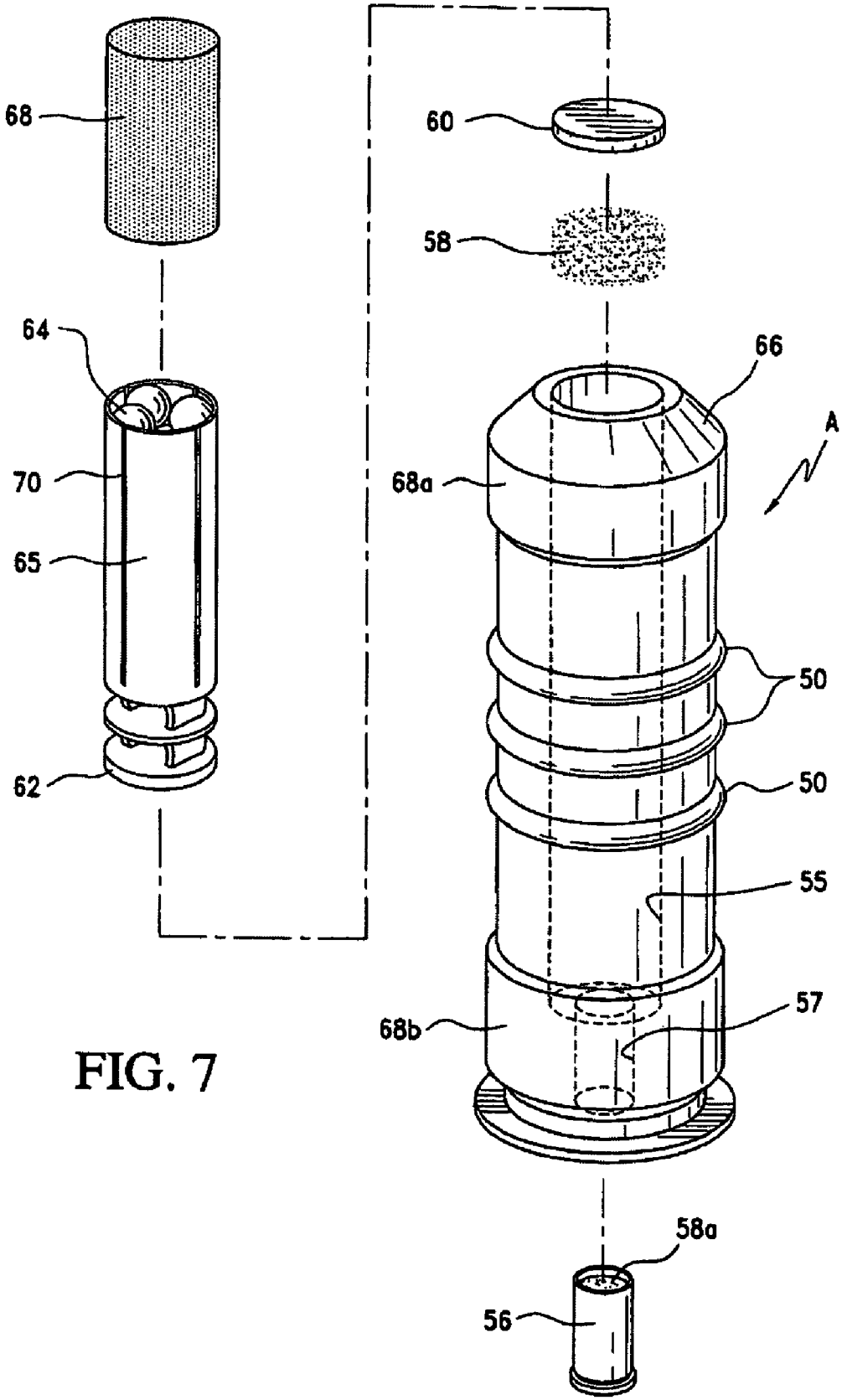
FIG. 7 is an assembly view of the inventive high-pressure fixed munition shown in FIG.

A conventional .38 Smith and Wesson cartridge case 56 is inserted into the small bore 57 of the high-pressure munition A as best seen in FIG. 6. The bore 55 has a larger diameter than the small bore 57 and is thus a large bore (i.e., large bore 55) with respect to the small bore 57. Referring to FIG. 5, the lower flat 59 of the large 55 extends between sidewall portions of the large bore 55 and the small bore 57, thus defining a ledge portion therebetween. As shown in FIG. 5, the ledge portion is substantially flat and extends substantially parallel with the base surface 67 of the body 52. A primer 54 is inserted into the base of the .38 Smith and Wesson cartridge case 56. Alternative cartridge cases may also be used. Propellant 58 is inserted from the top of the high-pressure munition A to provide the desired pressure for the load used.

An alternative embodiment shown in FIGS. 8 and 9 includes a shotgun shell primer 70 that ignites the propellant 58 to discharge the buckshot 64*a*, or other desired payload. A preferred shotgun shell primer 70 is the Federal 209A, but other primers may also be used. The shotgun shell primer 70 fits into the shotgun shell primer bore 72. The shotgun shell primer 70 may either be flush with the base surface 67 of the high-pressure fixed munition A or may be raised slightly above the base surface 67 as shown in FIG. 8. It is contemplated that any primer that provides the necessary ignition for the propellant may also be used in place of the shotgun shell primer 70.

An optional burst disk 60 is inserted above the propellant 58. The burst disk 60 seals off propellant charge from the base of the high-pressure munition A, retaining the propellant 58 sufficient for efficient power combustion. Because the propellant 58 bears against the burst disk 60 and does not use an expansion chamber, the pressure front from the propellant gasses is prevented from distorting the body 52 of the high-pressure munition A.

The burning characteristics of the propellant 58 can be adjusted to allow the use of frangible projectiles, which can distort and fracture under pressure.

A wad 62 is inserted above the burst disk 60. The wad 62 includes a shot cup portion 65, into which projectiles are inserted. Because of the large volume available in the bore 55 of the high-pressure fixed munition A relative to the volume available in a conventional shotgun shell 35 shown with the prior art sub-caliber adapter P2 in FIG. 2, a greater amount of projectiles can be used. In FIG. 6, twenty-five "00" frangible buckshot pellets are shown; in FIG. 6A, twenty "00" buckshot pellets are shown; and in FIG. 6B, three frangible slugs are shown. The loads that can be used in the high-pressure fixed munition A are not limited to those shown and may also include other desired loads and varieties of projectiles. In place of conventional projectiles, paint balls may also be shot from the high-pressure fixed munition A. Paint ball rounds can be used for training or marking purposes. Other projectiles, such as rubber pellets, cloth stun bags, or batons can also be used.

It should be appreciated that the bore 55 can be enlarged for example, when paint balls are to be used, and can be otherwise changed in size as desired.

The exit of the bore 55 can be reduced in diameter to form a choked taper 74 (FIG. 10) of desired configuration to modify the resulting spread pattern of the projectile pellets 64, 64*a*. FIG. 10 also illustrated the choke angle 74*a* that defines the taper of the choke 74. The barrels B1, C1 cannot be choked to adjust the spread pattern because such a restriction would prevent the sabot 20 from exiting the bore of the launcher. This is another significant advantage of the high-pressure fixed munition.

The body 52 of the high-pressure fixed munition A is typically constructed of thermoplastic nylon 6/12, but can also be constructed of glass filled nylon, other desired polymer or a desired metal, such as aluminum. Other metallic materials or a combination of different materials, including, but not limited to polymer with metallic construction are also contemplated.

The high-pressure fixed munition A may be used as an expendable munition or may be reloaded. The body 52 material may be reused many times if desired.

The pressure containment properties of the body 52 allow the high-pressure fixed munition A to retain the high pressure of the gasses from the propellant 58 thereby allowing the use of the high-pressure fixed munition A in the M79/M203/M203a grenade launchers, which were originally designed for use with low pressure munitions. The pressure developed in the high-pressure fixed munition A is 12,000-15,000 psi, which exceeds the allowable working pressure of 3,000 of the M79/M203/M203a grenade launchers. The reason the high-pressure fixed munition can be operated safely in the low-pressure grenade launchers is because the bore 55 of the high-pressure fixed munition A acts as the barrel, effectively replacing the barrel B1*a* of the M203 (FIG. 3) and the barrel C1 of the M79 (FIG. 4). The high pressures developed in the high-pressure fixed munition are exposed to the bore 55 of the body 52 of the high-pressure fixed munition and they are not exposed to the inner bore of the barrels of the low pressure grenade launchers.

Closed cell foam 68 may be inserted in the top of the high-pressure fixed munition A to seal off the contents thereof from mud, sand, water or other debris. Multi-purpose latex foam, such as that manufactured by DAP.®, may be used but other foams can also be used. The important characteristics include: providing a water barrier, low density, high toughness and resilience. Biodegradable, closed cell foam can also be used to allow the high-pressure fixed munition A to be environmentally compatible.

Raised ridges 50 (FIGS. 5, 6, 6A, 6B and 7) on the outside of the body 52 are designed to allow the identification of the loading of the high-pressure fixed munition A in any light condition. For example, there can be a single raised ridge 50 for high-pressure fixed munition A containing "00"frangible buckshot pellets, two raised ridges 50 for "00"buckshot and three raised ridges 50 for frangible slugs. The different loadings of the high-pressure fixed munition A may also be identified by different colors. The raised ridges 50 also assist in centering the high-pressure munition A in the bore of the weapon. Thus, means for uniquely identifying a payload contained in a body of a high-pressure fixed munition configured in accordance with the present invention can include a corresponding configuration of raised ridges on an outside portion of the body of the high-pressure fixed munition, a corresponding configuration of colored markings on an exterior surface of the high-pressure fixed munition, or both.

As indicated by the following tables, the performance of the high-pressure fixed munition A is far superior to the performance of either the XM576 (P1) or the sub-caliber adapter (P2).

Comparison of Performance between High-Pressure Fixed Munition to M576 and Sub-Caliber Adapter
High-Pressure Fixed Munition (A)*

| Load | 3-12 gauge frangible slugs (1075 grains) | 20-"00" buckshot (1075 grains) | 25-"00" frangible buckshot (1075 grains) | 26-#1 buckshot (1075 grains) |
|---|---|---|---|---|
| Muzzle Velocity (ft/sec) | 1250 | 1250 | 1250 | 1250 |
| Range (yards) | 65 | 65 | 65 | 65 |
| Dispersion (spread pattern) at 25 yards | As desired** | As desired** | As desired** | As desired** |

*Muzzle velocities are based on estimate from penetration rates measured at 10 feet and 30 feet ranges.
**Dispersion (spread pattern) is adjustable by restricting the exit bore 55 (choking) of the high-pressure fixed munition.

| XM576 (P1) | | |
|---|---|---|
| Load | 20-#4 buckshot (380 grains) | 27-#4 (513 grains) |
| Muzzle Velocity (ft/sec) | 885 | 850 |
| Range (yards) | 10 | 10 |
| Dispersion (spread pattern) at 25 yards | 36 | 36 |

| Sub-Caliber Adapter (P2) | |
|---|---|
| Load | 3½ Shell with 12-"00" buckshot |
| Muzzle Velocity (ft/sec) | 850 |
| Range (yards) | 10 |

The high-pressure fixed munition A is a more effective munition than either the XM576 (P1) or the sub-caliber adapter (P2). The high-pressure fixed munition A has a higher muzzle velocity than both the XM576 (P1) and the sub-caliber adapter (P2), even though the high-pressure fixed munition A fires projectile loads that are heavier than those fired in the XM576 (P1) and the sub-caliber adapter (P2). The larger pressures that are developed in the high-pressure fixed munition A results in the higher velocities and also provides increased ranges of the projectiles. Furthermore, loads of 18 or 20 pellets of "00" buckshot or 25 pellets of frangible "00" buckshot shot from the high-pressure fixed munition result in a shot pattern of approximately 4" at 10 feet and 8" at 30 feet. It is believed that the tight shot pattern is the result of a pressure front that travels in front of the propellant and that surrounds the pellet load as it travels away from the barrel B1, B1A. The pressure front tends to contain the pellet load in a desirable, tight pattern.

Even though the high-pressure fixed munition A develops pressures exit pressures that are 12,000-15,000 psi, the high pressures in combination with the large loads do not create large recoils to the shooter. Instead, it is believed that the large mass of the weapons in which the high-pressure fixed munition A are fired absorbs the energy and resists transferring the recoil inertia back to the shooter. The lack of heavy recoil is an important feature with the high-pressure fixed munition A because it reduces the tendency for a shooter to flinch, in anticipation of a large recoil, thereby losing his or her concentration and accuracy.

The length of the barrel C1 on the M79 (C) (FIG. 4) is 14 inches. The length of the barrel B1 on the M203 (FIG. 3) is 10 inches. On the M203a (not shown), the length of the barrel is only 8 inches. When either the XM576 (P1) or the sub-caliber adapter (P2) are fired through different length barrels, the performance varies. The resulting spread can change as well as the velocity, range and accuracy. The muzzle velocity, range and accuracy of projectiles fired from the high-pressure fixed munition A are independent of the length of the barrel. It should be appreciated that the invention disclosed herein may also be used in varying sizes of launching systems other than the 40 mm sized systems.

Because many varying and different embodiments may be made within the scope of the inventive concept herein taught and claimed, and because many modifications may be made in the embodiments herein detailed in accordance with the descriptive requirements of the law, it is to be understood that the details herein are to be interpreted as illustrative and not in a limiting sense.

What is claimed is:

1. A fixed munition for use in a barrel of a low-pressure launching unit, the fixed munition comprising:

a cylindrical body having a centrally located bore, a charge end and a discharge end;

said bore having a reduced diameter on said charge end thereby defining a ledge portion within said bore, wherein a length of said bore extending from the ledge portion to the discharge end or approximately to the discharge end has a substantially constant diameter;

a primer charge positioned in said reduced diameter of said body on said charge end;

said bore being filled above said primer charge with a propellant and being filled above said propellant with a payload; and means for uniquely identifying said payload contained in said body;

wherein said body having a construction configured to withstand high pressure developed within said bore thereof that exceeds an allowable working pressure of the barrel of the low-pressure launching unit and is configured such that said high pressure developed within said bore thereof that exceeds the allowable working pressure of the barrel of the low-pressure launching unit is not exposed to an inner bore of the barrel of the low-pressure launching unit whereby said body of the fixed munition withstands said high pressure thereby acting as the barrel of the low-pressure launching unit, wherein the allowable working pressure does not exceed approximately 3000 pounds per square inch, and wherein said high pressure that exceeds the allowable working pressure of the barrel of the low-pressure launching unit is between approximately 12,000 pounds per square inch and approximately 15,000 pounds per square inch.

2. A fixed munition according to claim 1 wherein an entire portion of said body is unitarily constructed from a single material composition.

3. A fixed munition according to claim 1 wherein the allowable working pressure of the barrel of said low-pressure launching unit is approximately 3000 pounds per square inch.

4. A fixed munition according to claim 1 wherein said bore has a reduced diameter along the inner surface toward said discharge end whereby the shot pattern of said payload discharges from said discharge end in a desired overall pattern.

5. A fixed munition according to claim 1 wherein said payload is selected from the group consisting essentially of: multiple buckshot pellets, frangible buckshot pellets, tear gas, multiple slugs, frangible slugs, paint balls, rubber pellets, flechettes and bean bags.

6. A fixed munition according to claim 1 that includes a wad container inside said bore for holding said payload.

7. A fixed munition according to claim 1 that includes a foam material on top of said payload for keeping material out of said bore.

8. A fixed munition according to claim 1 wherein said body is constructed of a metal material.

9. A fixed munition according to claim 8 wherein the metal material comprises aluminum.

10. A fixed munition according to claim 1 wherein said body is constructed of a combination of a polymeric material and a metal material.

11. A fixed munition according to claim 10 wherein said polymeric material comprises thermoplastic nylon.

12. A fixed munition according to claim 11 wherein said polymeric material comprises glass filled nylon.

13. A fixed munition according to claim 1 further comprising a region having an enlarged diameter proximate to said exit end of said cylinder and having an enlarged diameter proximate to said charge end whereby said munition is centered within the bore of the launching unit.

14. A fixed munition according to claim 1 further comprising a blast disc positioned between said propellant and said payload.

15. A fixed munition for use in a low-pressure launching unit, the fixed munition comprising:

a cylindrical body having a charge end, a discharge end and a central through bore;

said cylindrical body having a bore of smaller diameter than said through bore and being centrally positioned in said charge end whereby said smaller diameter bore defines a ledge portion within said bore, wherein said through bore has a first substantially constant diameter along its entire length or approximately its entire length and wherein said smaller diameter bore has a second substantially constant diameter along its entire length or along approximately its entire length;

a primer positioned in said smaller diameter bore on said charge end;

a propellant above the primer;

a payload above said propellant;

at least one of at least one raised ridge about the circumference of said body for purposes of uniquely identifying said payload contained in said body and a specific color of material provided on said body for purposes of uniquely identifying said payload contained in said body; and said cylindrical body having a construction configured to withstand high pressure developed within said bore thereof that exceeds an allowable working pressure of a barrel of the low-pressure launching unit and is configured such that said high pressure developed within said bore thereof that exceeds the allowable working pressure of the barrel of the low-pressure launching unit is not exposed to an inner bore of the barrel of the low-pressure launching unit whereby said body of the fixed munition withstands said high pressure thereby acting as the barrel of the low-pressure launching unit, wherein the allowable working pressure of the barrel of said low-pressure launching unit is approximately 3000 pounds per square inch and wherein said high pressure that exceeds the allowable barrel working pressure of the low-pressure launching unit is 12,000 pounds per square inch to 15,000 pounds per square inch.

16. A fixed munition according to claim 15 wherein said body is constructed of a combination of a polymeric material and a metal material.

17. A reusable fixed munition for use in a barrel of a low-pressure launching unit, the reusable fixed munition comprising:

a cylindrical body having a centrally located bore, a charge end and a discharge end;

said bore having a reduced diameter on said charge end;

a primer charge positioned in said reduced diameter of said body on said charge end;

said bore being filled above said primer charge with a propellant and being filled above said propellant with a payload;

a foam material on top of said payload for keeping material out of said bore;

a charge end step portion adjacent the primer charge;

a discharge end step portion adjacent the foam material;

at least one raised ridge about the circumference of said body for purposes of uniquely identifying said payload contained in said body; and said body being constructed to contain high pressure within said bore of approximately 12,000-15,000 pounds per square inch and whereby the fixed munition retains said high pressure thereby acting as the barrel of the low-pressure launching unit.

18. A reusable fixed munition according to claim 17 wherein said body is constructed of a combination of a polymeric material and a metal material.

* * * * *